United States Patent [19]

Harmony

[11] 4,346,844

[45] Aug. 31, 1982

[54] AERATED PULSATING SHOWER HEAD

[75] Inventor: Richard C. Harmony, Tucson, Ariz.

[73] Assignee: Conservation Associates Incorporated, Newark, Del.

[21] Appl. No.: 116,226

[22] Filed: Jan. 28, 1980

[51] Int. Cl.[3] ..... B05B 1/08; B05B 1/18; B05B 7/00

[52] U.S. Cl. ..... 239/383; 239/394; 239/396; 239/428.5; 239/447; 239/460

[58] Field of Search ..... 239/101, 102, 382, 383, 239/394, 396, 428.5, 443, 447, 460

[56] References Cited

U.S. PATENT DOCUMENTS

| | | | |
|---|---|---|---|
| 2,936,958 | 5/1960 | Shames et al. | 239/460 X |
| 3,014,665 | 12/1961 | Shames et al. | 239/428.5 X |
| 3,801,018 | 4/1974 | Plotz | 239/383 X |
| 4,151,957 | 5/1979 | Gecewicz | 239/447 X |
| 4,191,332 | 3/1980 | De Langis et al. | 239/428.5 |

*Primary Examiner*—Andres Kashnikow
*Attorney, Agent, or Firm*—Cahill, Sutton & Thomas

[57] ABSTRACT

A stream of water introduced to a shower head is split into two paths. The first water path is discharged in the form of a cone shaped spray. The second water path is channeled into a chamber containing a rotor rotationally responsive to the flow of water into the chamber and which rotor includes a chopper for regulating pulsed discharges of water through varying ones of a plurality of discharge ports. The proportional water flow in the two water paths is selectively variable. Air is introduced to the stream of water upstream of the water path split to aerate the water and reduce the quantity of water flow without an apparent water flow reduction to a user. A non-pulsating aerated shower head is also described.

9 Claims, 8 Drawing Figures

AERATED PULSATING SHOWER HEAD

The present invention relates to shower heads and, more particularly, to aerated shower heads.

Pulsating shower heads have been known for some years. These shower heads, assuming that they are actuated by the flow of water therethrough, include a plurality of interacting parts for rapidly initiating and terminating water flow through each of a plurality of discharge ports. The multiplicity of parts renders them expensive to manufacture. Moreover, the co-action necessary between multiple moving parts is highly intolerant of any changes in configuration of the parts due to wear. Hence, malfunction often occurs.

In some pulsating shower heads, there exists total cessation of water flow during repetitive time increments. The resulting pressure variations are translated up-stream as detonations, because of the incompressibility of water, which detonations may have destructive effects upon the plumbing. Additionally, these detonations require very robust construction of the shower head itself.

Other pulsating shower heads require a relatively high pressure water source in order to function adequately. This requirement may not be met in all municipalities, depending upon the ambient water head in situ. Should the water pressure be marginally adequate, the pulsating operation of the shower head is less than satisfactory and will cease altogether were the water pressure to drop below a minimum value.

Of the pulsating shower heads known, none incorporate water saving features other than that of simply restricting the water flow rate to a predetermined value. This method of water saving is not very satisfactory to the user as he will immediately note an apparent inadequacy of water quantity and water spray force. The resulting dissatisfaction may cause the user to discard the pulsating shower head.

Aerated shower heads are known, as evidenced by U.S. Pat. No. 4,072,270 describing an invention by the present inventor. These shower heads, because of the aeration, provide a flow of water which seems totally adequate to the user yet the actual water discharged is less than that of conventional shower heads providing the same affect to the user. Accordingly, a water savings, resulting in a more meaningful savings in the cost of heating the water, is realized without any detriment to the user.

It is therefore a primary object of the present invention to provide an aerated pulsating shower head.

Another object of the present invention is to provide a pulsating shower head which has only a single moving part responsible for generating the pulsations.

Still another object of the present invention is to provide a pulsating shower head which is infinitely adjustable between limits to vary the proportion of pulsated water spray and conventional water spray.

Yet another object of the present invention is to provide an aeration system for a pulsating shower head which provides aerated constant and pulsating water sprays.

A further object of the present invention is to provide an inexpensive aerated pulsating shower head.

A still further object of the present invention is to provide an aerated pulsating shower head which conserves the water flow rate without a detrimental effect upon a user.

A yet further object of the present invention is to provide a means for aerating the flow of water through a shower head.

These and other objects of the present invention will become apparent to those skilled in the art as the description thereof proceeds.

The present invention may be described with greater specificity and clarity with reference to the following drawings, in which.

Figure 1:
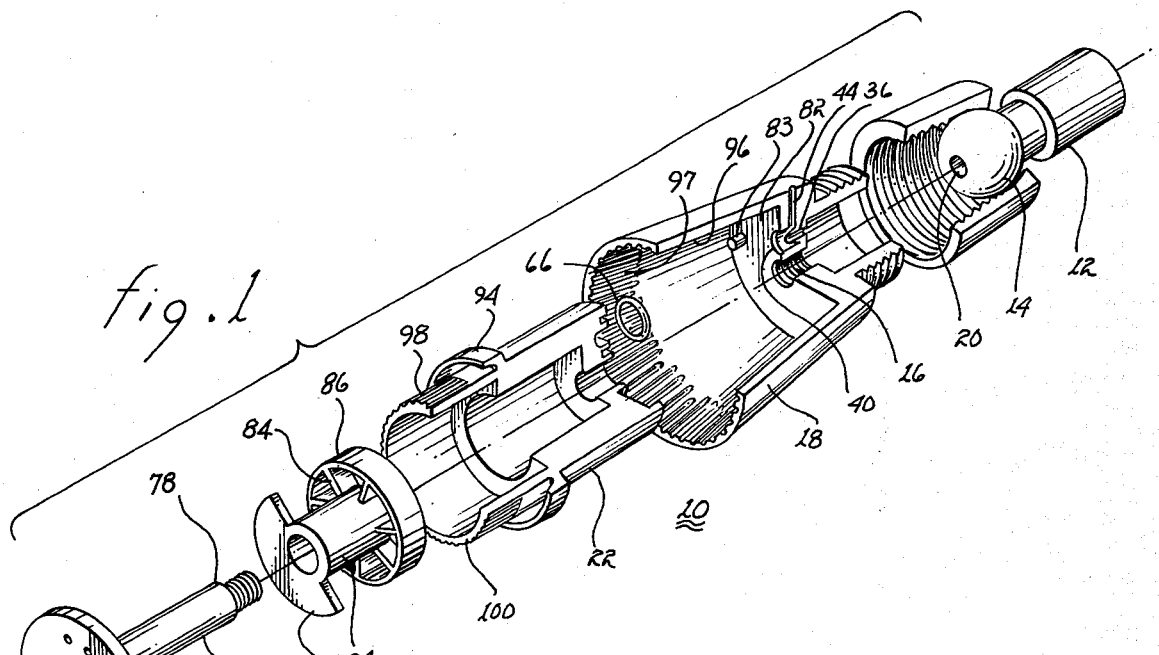
FIG. 1 is an isometric view of the various components of the pulsating shower head.

The major components of an aerated pulsating shower head 10 incorporating the teachings of the present invention are illustrated in FIG. 1. A coupling 12 is threadedly attachable to a conventional threaded pipe extending from the wall within a shower stall or above a bath tub. The coupling includes a channeled ball 14. A collar 16 threadedly engages an outer shell 18 and maintains the outer shell in leak-free fluid communication with water outlet 20 of the ball. As is well known, such a connection (as illustrated in further detail in FIG. 2) is well known to provide pivotal movement for the attached element without water leakage.

An inner shell 22 is rotatably mounted within the outer shell. The inner shell includes channeling members for spliting the water flow path into a conventional water spray and a pulsating water spray. A rotor 24 is rotatably mounted interior of inner shell 22 and creates the pulsating water spray. A stator 26 includes a disc 28 apertured with discharge ports 30 through which the pulsating water is discharged and a stem 32 for rotatably supporting rotor 24 and interlocking inner shell 22 with outer shell 18.

Figure 2:
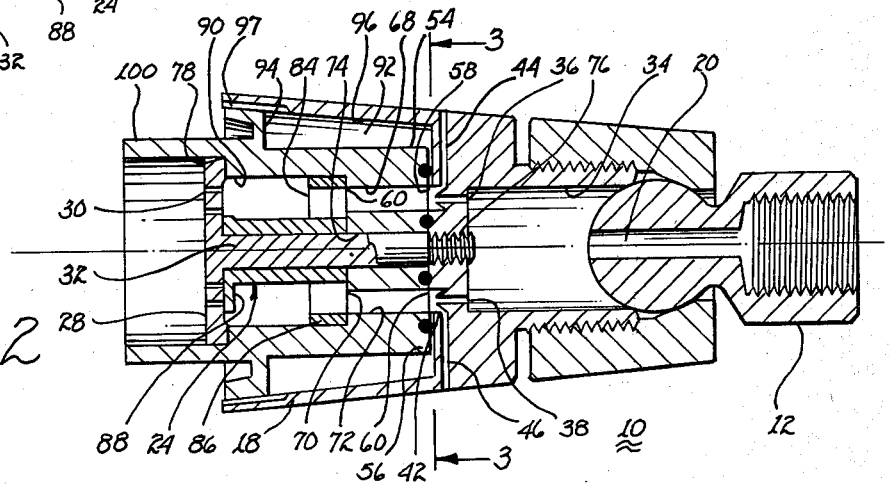
FIG. 2 is a cross-sectional view of an assembled pulsating shower head.

Referring jointly to FIGS. 1 and 2, various structural details of shower head 10 will be described. Outer shell 18 includes a plenum chamber 34 for receiving the water discharged through outlet 20. Passageways 36 and 38 extend from the plenum chamber to annular depressions 40 and 42, respectively. Further passageways 44 and 46 provide fluid communication with ambient air adjacent the exterior surface of outer shell 18.

Passageways 44 and 46 aerate the water flowing through passages 36 and 38 in the following manner. As the water flows from plenum chamber 34 to the respective ones of annular depressions 40 and 42, the pressure at the passageway outlets and within the annular depressions will be reduced below ambient pressure in conformance with Bernoulli's theorem. The resulting low pressure results in a flow of air into the annular depressions through the respective one of passageways 44 and 46. The stream of introduced air is entrained and otherwise mixed with the water. Accordingly, the water flowing out of the respective annular depressions has become aerated.

Referring jointly to all of the figures, the structure attendant inner shell 22 and outer shell 18 which effects the split water flow path to produce the pulsating spray and the constant spray will be described. Inner shell 22 includes a diametrically extending land 48 defining diametrically opposed cutouts 50 and 52. The land supports a pair of annular shoulders 54, 56 concentric with inlets 58, 60 defined by circumscribing annular shoulders 62, 64, respectively. O-rings 57 and 59 are disposed intermediate the respective paired annular shoulders. Inlet 58 is in fluid communication with outlet 66 through a slanted passageway 68. Similarly, inlet 60 is in fluid communication with outlet 70 through a slanted passageway 72. Inlets 58 and 60 are positionally mateable with annular depressions 40 and 42, respectively; moreover, the diameter of each of inlets 40 and 42 is dimensioned greater than the distance extending across the pair of concentric annular shoulders attendant each of inlets 58 and 60.

Stem 32 penetratingly engages smooth surfaced passageway 74 disposed central to inner shell 22 and threadedly engages threads 76 of outer shell 18 to draw the inner shell into the outer shell. The stem maintains the inner shell in contacting relationship with the outer shell through the force exerted by disc 28 bearing against shoulder 78 in the inner shell. It is to be noted that the inner shell is not fixedly attached to the outer shell and only sufficient force is employed to compress O-rings 66 and 68 against surface 82 of the outer shell and relative rotation between the inner shell and the outer shell about stem 32 is afforded. The extent of rotation between the inner shell and the outer shell is controlled by pin 83 extending from surface 82. The pin mates with one of cut-outs 50 or 52. The extent of rotation of the inner shell with respect to the outer shell is regulated by pin 83 and one or another of the opposed edges of the respective cut out.

Figure 3:
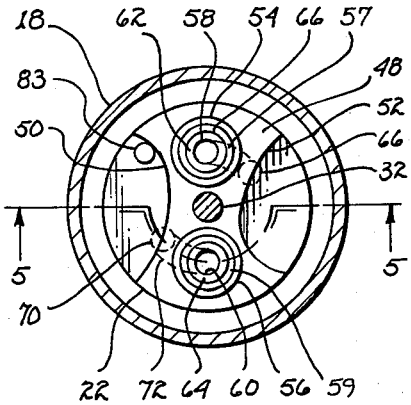
FIG. 3 is an end view taken along lines 3—3, as shown in FIG. 2.
Figure 4:
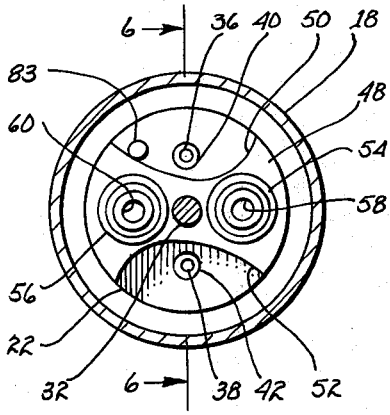
FIG. 4 is a cross-sectional view showing the inner shell rotated from the position shown in FIG. 3.
Figure 5:
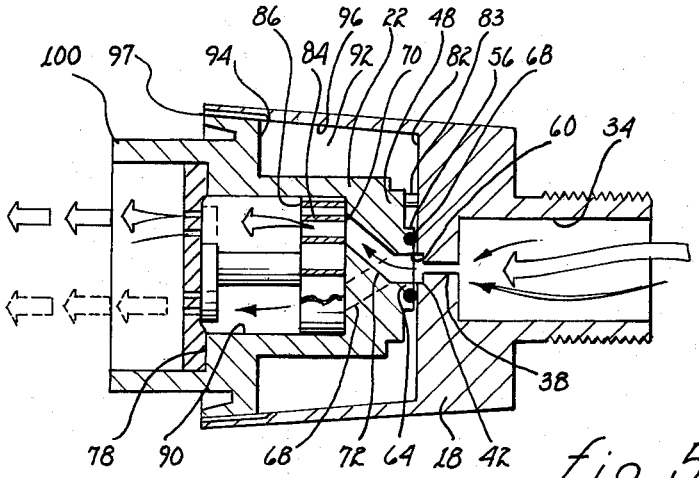
FIG. 5 is a cross-sectional view taken along lines 5—5, as shown in FIG. 3.
Figure 6:
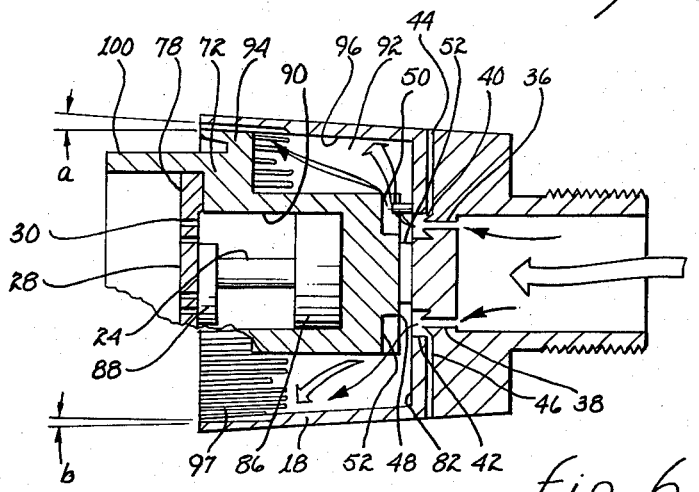
FIG. 6 is a cross-sectional view taken along lines 6—6, as shown in FIG. 4.

By appropriately locating pin 84, rotation of inner shell 22 with respect to outer shell 18 will position annular depressions 40 and 42 in coincident relationship with inlets 58 and 62, respectively, as shown in FIGS. 3 and 5 or with cutouts 50 and 52, respectively, as shown in FIGS. 4 and 6. In the former case, all the water flowing through the annular depressions will flow into the inlets; in the later case, all of the water will flow into the space defined by the cutouts. By rotationally positioning inner shell 22 at some intermediate point, the annular depressions will be placed in fluid communication with one of the inlets and one of the cut-outs in variable proportions depending upon the rotational position of the inner shell with respect to the outer shell.

Rotor 24 is rotatably mounted upon stem 32; it may include a bearing surface in contacting relationship to the supporting face of disc 28 to reduce the friction therebetween. The rotor includes a plurality of blades 84 extending radially and interconnected with one another by a ring 86 to provide structural support therefor. The other end of the rotor includes a chopper 88, which chopper is a semicircular planar element. It is to be understood that the angle defined by the chopper may be greater or lesser than the 180° illustrated. On mounting of rotor 24 upon stem 32, chopper 88 is placed adjacent some of discharge ports 30 and thereby covers them. As will be self-evident, rotation of rotor 24 with respect to disc 28 cyclically uncovers and covers different ones of the discharge ports repetitively to permit and impede water flow therethrough. Thereby, the spray discharged through disc 28 comprises a series of pulses of water defining the pulsating spray.

Passageways 68 and 72 channel the water flowing thereinto at an angle with respect to the axis presented by stem 32. These laterally directed resulting streams of water will strike blades 84 of rotor 24 and impart a force causing the rotor to rotate. The water striking blades 84 flows therepast into chamber 90, wherefrom the water discharged through the uncovered ones of discharge ports 30.

The water flowing into cut-outs 50 and 52 is free to flow laterally therefrom into annular chamber 92 defined by exterior surface of inner shell 22 and the interior surface of outer shell 18. Inner shell 22 includes a radially extending shoulder 94 bearing against inner surface 96 of the outer shell. Water flow intermediate radial shoulder 94 and surface 96 is effected through grooves 97 disposed in the surface. Each of these grooves defines a stream of water and all of them in combination define a constant cone shaped water spray having an angle commensurate with the cone angle of surface 96 and the grooves disposed therein. To provide a more pleasant spray pattern for the user, every fourth groove is at an angle of three degrees with respect to the cone angle while the remaining grooves are at an angle of five degrees with respect to the cone angle.

By varying the rotational position of inner shell 22 with respect to outer shell 18, the proportion of water flowing through cut-outs 50, 52 or inlets 58, 60 is variable from zero to maximum. Thereby, the proportion of pulsating water spray with respect to the constant water spray is readily adjustable by the user. Knurling 98 or the like may be disposed upon shroud 100 extending from inner shell 22 to aid in gripping the inner shell and turning it.

Figure 7:
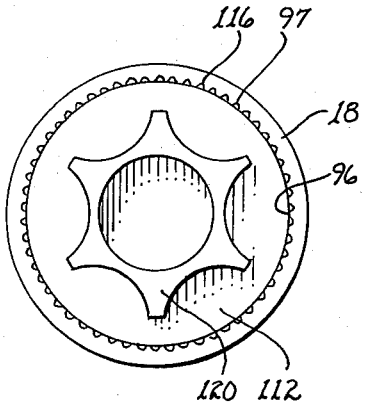
FIG. 7 illustrates an end view of a variant of the present invention.
Figure 8:
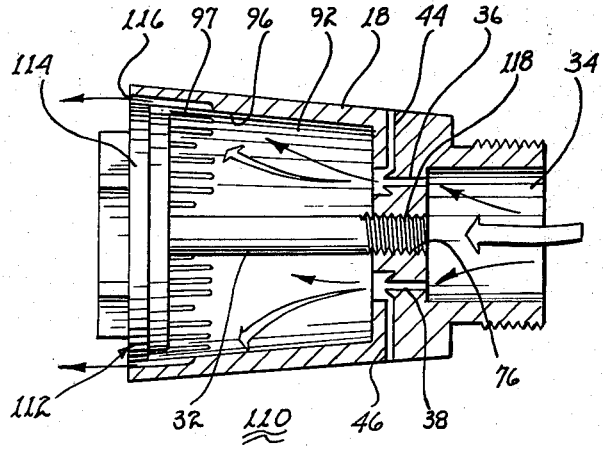
FIG. 8 illustrates a cross-sectional view of the variant shown in FIG. 7.

Referring to FIGS. 7 and 8, there is shown a variant shower head 110 of shower head 10 shown in FIG. 1 which aerates but does not pulsate the water spray discharged from the shower head. Outer shell 18 includes a chamber 34 for receiving water from an attached source of water (not shown); a coupling, as illustrated in FIG. 1, may be employed to effect the attachment. The water flows from chamber 34 through passageways 40, 42 into chamber 92. While flowing through the passageways, air is drawn into the water through passageways 44, 46 and becomes entrained in the water. Further mixing of the air and water will occur within chamber 92. Inner surface 96 of the skirt of outer shell 18 includes a plurality of grooves 97 disposed proximate the end of the skirt; these grooves may be configured as discussed above with respect to FIGS. 1, 2 and 6.

A disc 112, having a perimeter surface 114 slanted to the cone angle of the skirt (surface 96) is positionable adjacent grooves 97 to define in combination with the grooves discharge ports 116. Stem 32 includes a threaded end 118 for threadedly engaging threads 76 in the outer shell.

A star shaped finger grip 120 is disposed on the external surface of disc 112 to permit manual rotation of the disc. Such rotation, by action of threaded end 118 draws the disc toward or away from grooves 97 to provide the possibility of varying the size of discharge ports 116. Alternatively, the disc may be tightly secured in place to provide constant size discharge ports.

From the above description, it will be apparent that variant shower head 110 is an adaptation of shower head 10 which employs the same outer shell and an inexpensively producible insert for developing the spray pattern. Both shower heads, by operation of the outer shell, provide an aerated water spray.

Such an aerated water spray seemingly to a user provides a normal quantity of water for a given water force. However, the actual water flow rate is less. The reduced flow rate provides some savings in the cost of the water but more importantly requires less water to be heated and the reduction in heating costs is significant.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. An aerated pulsating shower head connectable to a source of water under pressure, said shower head comprising in combination:

(a) an outer shell, said outer shell including a first chamber for receiving the water under pressure and a second chamber;

(b) a pair of diametrically opposed passageways disposed in said outer shell and interconnecting said first and second chambers, each of said pair of passageways including an outlet disposed in said second chamber;

(c) means for aerating the water flowing through at least one of said passageways;

(d) an inner shell disposed within said second chamber, said inner shell being positionally rotatable with respect to said outer shell, said inner shell including a third chamber;

(e) a pair of further passageways extending from said one end of said inner shell into said third chamber, each said further passageway including an inlet positionable coincident with an outlet of said pair of passageways in said outer shell;

(f) means disposed in said one end for directing a proportionate flow of water from at least one of said pair of passageways into said second chamber and through at least one of said further passageways into said third chamber, depending upon the relative rotational position of said inner shell with respect to said outer shell;

(g) a rotor rotatably mounted within said third chamber, said rotor being rotationally responsive to the flow of water through said further passageways into said third chamber;

(h) a disc having a pattern of discharge ports for discharging water from said third chamber;

(i) a chopper operatively associated with said rotor for intermittently terminating water flow through some of said discharge ports to produce a pulsating water spray; and (j) a plurality of grooves interconnected with said second chamber for discharging water as a spray from said second chamber.

2. The shower head as set forth in claim 1 wherein said means for aerating includes a first passageway interconnecting one of said pair of passageways in said outer shell with ambient air and a second passageway interconnecting the other of said pair of passageways in said outer shell with ambient air.

3. The shower head as set forth in claim 2 wherein said directing means includes a land supporting said inlets and cut-outs, said inlets and said cut-outs being proportionally positionable coincident with the outlets of each of said pair of passageways in response to rotation of said inner shell with respect to said outer shell.

4. The shower head as set forth in claim 1 including a stem for supporting said disc, rotatably supporting said rotor and rotatably locating said inner shell within said second chamber.

5. The shower head as set forth in claim 4 wherein said further passageways are slanted for providing a lateral component of force to the water flowing therethrough and impinging upon said rotor and causing said rotor to rotate.

6. The shower head as set forth in claim 5 wherein said rotor includes blades responsive to the force of water flowing from said further passageways.

7. The shower head as set forth in claim 6 wherein said chopper is formed as a part of said rotor.

8. The shower head as set forth in claim 7 wherein said grooves include a first set of grooves aligned along one cone angle and a second set of grooves aligned along another cone angle to form two cones of spray.

9. An aerated pulsating shower head reversibly convertible to deliver a pulsating and continuous spray in any selectible proportion or only a continuous spray and connectable to a source of water under pressure, said shower head comprising in combination:

(a) an outer shell, said outer shell including a first chamber for receiving the water under pressure and a second chamber;

(b) at least one passageway extending from said first chamber to said second chamber;

(c) means for aerating the water flowing to said second chamber;

(d) an inner shell disposed within said second chamber, said inner shell being positionally rotatable with respect to said outer shell, said inner shell including a third chamber and at least one further passageway extending into said third chamber from one end of said inner shell;

(e) means disposed in said one end for directing a proportionate flow of water from at least one of said passageways into said second chamber and through said further passageway into said third chamber, depending upon the relative rotational position of said inner shell with respect to said outer shell;

(f) a rotor rotatably mounted within said third chamber, said rotor being rotationally responsive to the flow of water through said further passageway into said third chamber;

(g) a disc having a pattern of discharge ports for discharging water from said third chamber;

(h) a chopper operatively associated with said rotor for intermittently terminating water flow through some of said discharge ports to produce a pulsating water spray;

(i) a plurality of grooves interconnected with said second chamber for discharging water as a spray from said second chamber; and (j) means for discharging the aerated water within said second chamber as a continuous spray, said discharge means being selectively mountable within said second chamber in place of said inner shell, said directing means, said rotor, said disc and said chopper.

* * * * *